US006883202B2

(12) United States Patent
Steffen et al.

(10) Patent No.: US 6,883,202 B2
(45) Date of Patent: Apr. 26, 2005

(54) CLEANING AND TOOL STORAGE ASSEMBLY

(75) Inventors: Cennert Steffen, Bloomington, IL (US); Arnie Sepke, Hudson, IL (US); Vince Bobrosky, Normal, IL (US); Scott Terven, LeRoy, IL (US); John Morphey, Bloomington, IL (US)

(73) Assignee: White Consolidated, Ltd., Cleveland, OH (US)

( * ) Notice: Subject to any disclaimer, the term of this patent is extended or adjusted under 35 U.S.C. 154(b) by 318 days.

(21) Appl. No.: 10/143,183

(22) Filed: May 10, 2002

(65) Prior Publication Data

US 2003/0208874 A1 Nov. 13, 2003

(51) Int. Cl.[7] ..... A47L 9/32

(52) U.S. Cl. ..... 15/323; 15/344; 15/347; 15/331; 15/410

(58) Field of Search ..... 15/323, 344, 347, 15/339, DIG. 10, 410, 331; 206/372, 373, 576

(56) References Cited

U.S. PATENT DOCUMENTS

| | | | | | |
|---|---|---|---|---|---|
| 2,042,387 | A | * | 5/1936 | Cobb | 15/323 |
| 2,528,249 | A | * | 10/1950 | Serwin | 15/323 |
| 2,544,405 | A | | 3/1951 | Weir | |
| 2,603,816 | A | * | 7/1952 | MacFarland | 15/323 |
| 2,608,709 | A | * | 9/1952 | Benjamin | 15/323 |
| 3,170,185 | A | * | 2/1965 | Segesman | 15/347 |
| 3,254,359 | A | * | 6/1966 | Coll | 15/323 |
| 3,296,648 | A | * | 1/1967 | Schaefer | 15/323 |
| 4,955,105 | A | * | 9/1990 | Sunagawa et al. | 15/323 |
| 5,113,546 | A | | 5/1992 | Parent | 15/321 |
| 5,774,932 | A | | 7/1998 | Mallory et al. | 15/350 |

* cited by examiner

*Primary Examiner*—Theresa T. Snider
(74) *Attorney, Agent, or Firm*—Tarolli, Sundheim, Covell & Tummino L.L.P.

(57) ABSTRACT

A cleaning and tool storage assembly includes a housing having a base and a lid which is hingedly connected with the base. A vacuum cleaner assembly is disposed within the housing. A handle on the lid may be utilized to retain an electrical power cord. Articles, such as a hose, which are utilized in association with the vacuum cleaner, may be retained on the lid. A tray for holding items may be provided in the base of the housing. The tray may be removable from the housing to provide access to storage space. A cover for a dust bin of the vacuum cleaner may be opened with the tray in the housing.

20 Claims, 8 Drawing Sheets

CLEANING AND TOOL STORAGE ASSEMBLY

BACKGROUND OF THE INVENTION

The present invention relates to a cleaning and tool storage assembly which includes a vacuum cleaner disposed within a housing.

During various jobs, tools and/or parts may be required at a job site. Dust and debris may be created at the job site when drilling holes, sawing materials, or performing other functions. Before a job can be considered as being finished, this dust and debris must be cleaned up.

When the job involves a complicated machine, such as a copy machine, access may be provided to dust and debris. Because the dust and debris is not always readily accessible, it may be necessary to dislodge and relocate the dust and debris to a more accessible location for cleaning. In addition, tools and/or parts may be required to perform maintenance on the machine.

SUMMARY OF THE INVENTION

The present invention provides a new and improved cleaning and tool storage assembly which may be utilized to move tools and/or parts to a job site. The cleaning and tool storage assembly includes a housing in which a vacuum cleaner is disposed. The housing may include a lid. A tray may be provided to hold items in the base. If desired, the tray may be removable from the base to provide access to storage space in the housing.

It is contemplated that various articles, such as a hose and/or brush, may be used with the vacuum cleaner. These articles may advantageously be retained on a lid of the housing by retainers.

A handle may be provided on the lid to facilitate carrying of the cleaning and tool storage assembly. The handle may be utilized to store an electrical power cord which conducts electrical energy to the vacuum cleaner.

The vacuum cleaner may include a dust bin having a cover which is movable from a closed condition to an open condition to provide access to the interior of the dust bin. The cover for the dust bin may be disposed at a location within the housing where the cover can be moved to the open condition while the tray is disposed within the housing. An inlet, through which a flow of air with debris entrained in the air, is conducted into the dust bin, may be provided on the cover of the dust bin.

It should be understood that the present invention provides a cleaning and tool storage assembly having many different features. It is contemplated that the various features of the assembly may be used separately or in combination with each other. It should be understood that various combinations of the features other than the specific combinations disclosed herein may advantageously be utilized. Of course, features of the cleaning and tool storage assembly disclosed herein may be used with features of other known devices.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS

Cleaning and Tool Storage Assembly

Figure 1:
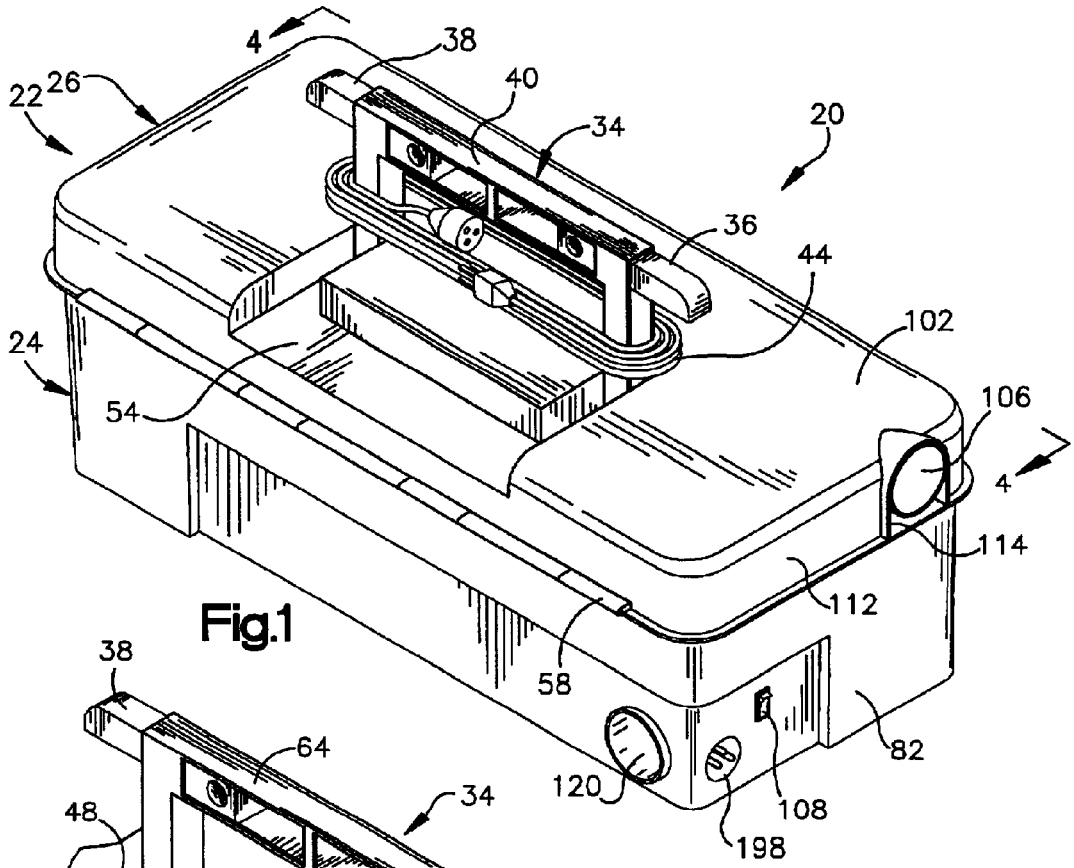
FIG. 1 is a pictorial illustration of a cleaning and tool storage assembly constructed in accordance with the present invention.

A cleaning and tool storage assembly 20 (FIG. 1) includes a housing 22 having a base 24 and a lid 26 hingedly connected with the base. Latches 28 and 30 (FIG. 4) are engageable to hold the lid 26 in the closed condition illustrated in FIGS. 1 and 4.

A handle 34 (FIGS. 1–4) is mounted on the lid 26. The handle 34 may have retainer members 36 and 38 which are movable relative to a manually engageable grip section 40 of the handle. When the retainer members 36 and 38 are in the extended condition illustrated in FIGS. 1 and 2, the retainer members are effective to hold a coiled electrical power cord 44 (FIG. 1) on the handle 34.

Figure 2:
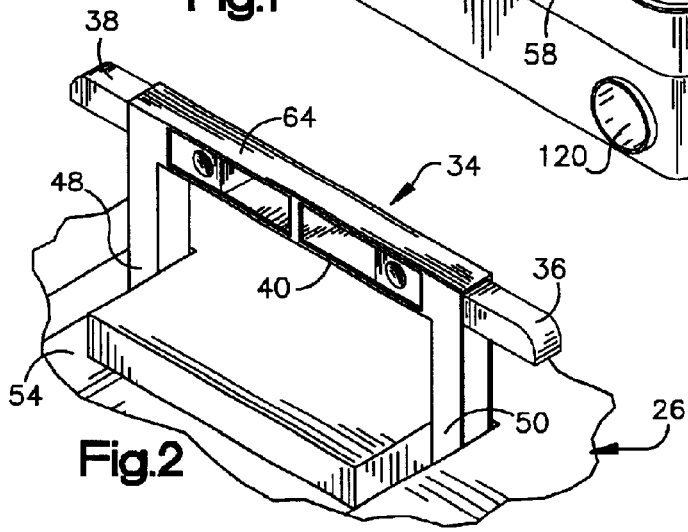
FIG. 2 is an enlarged pictorial illustration of a handle which may be utilized with the cleaning and tool storage assembly of FIG. 1.
Figure 3:
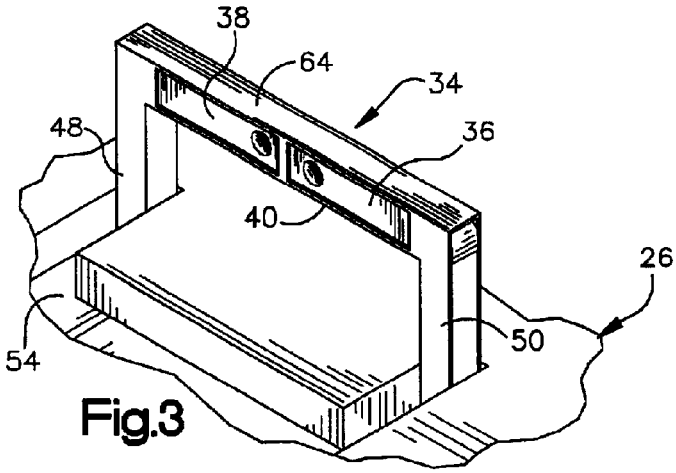
FIG. 3 is a pictorial illustration, generally similar to FIG. 2, illustrating the handle with the retainer members in a retracted condition.
Figure 4:
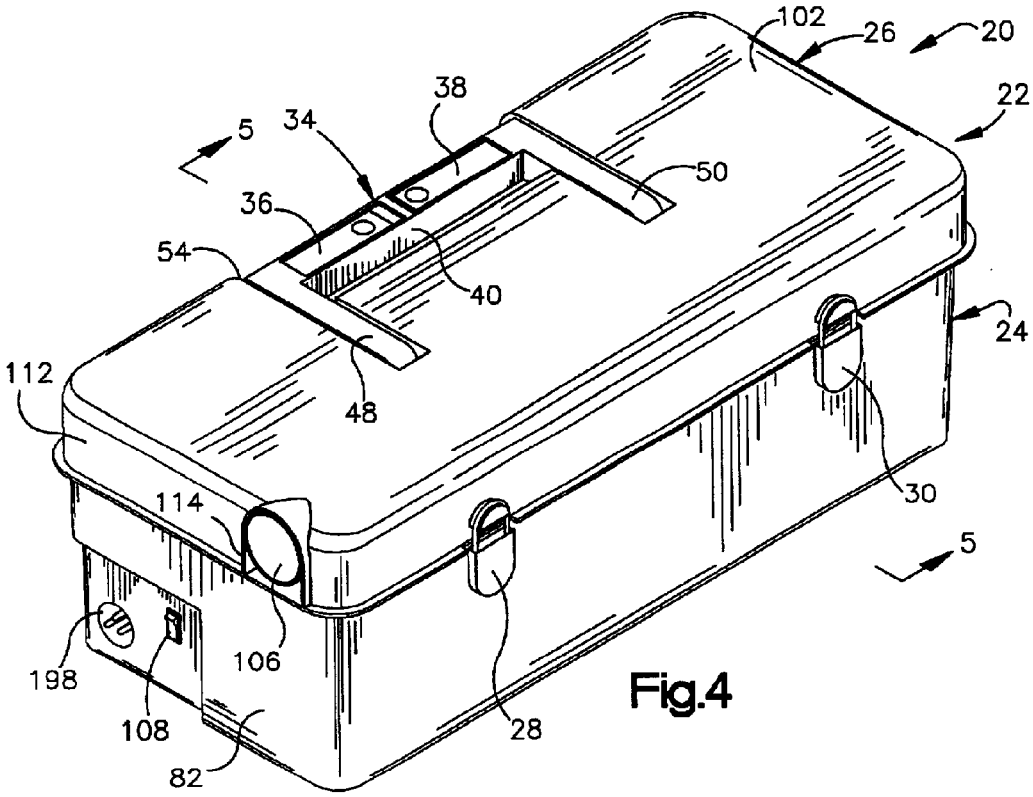
FIG. 4 is a pictorial illustration, taken generally along the line 4—4 of FIG. 1, of the cleaning and tool storage assembly with the handle of FIGS. 2 and 3 stored in a recess in a lid of a housing for the assembly.

The handle 34 is pivotally connected with the lid 26 of the housing 22 by a pair of mounting sections 48 and 50 (FIGS. 2, 3 and 4). Once the retainer members 36 and 38 have been moved to the retracted condition of FIG. 3 and the electrical power cord 44 (FIG. 1) removed from the handle 34, the handle can be pivoted relative to the lid 26 to a storage position illustrated in FIG. 4. When the handle 34 is in the storage position illustrated in FIG. 4, the grip section 40 of the handle is disposed in a recess 54 in the lid 26 so that the lid has a relatively smooth upper surface.

Figure 5:
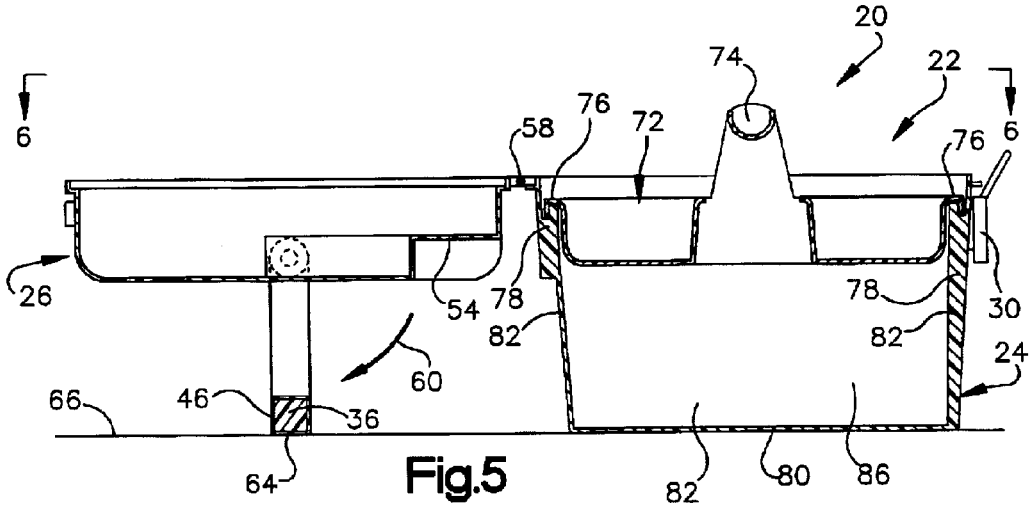
FIG. 5 is a simplified schematic sectional view, taken generally along the line 5—5 of FIG. 4, of the cleaning and tool storage assembly with the lid of the housing in an open condition.

When the latches 28 and 30 are in the release condition, the lid 26 can be pivoted at a hinge 58 (FIGS. 1 and 5)

interconnecting the lid 26 and base 24 of the housing 22. As the lid 26 is pivoted at the hinge 58, the handle 34 may pivot relative to the lid 26. This enables the handle 34 to move from the storage position shown in FIG. 4 to the extended position shown in FIG. 5, in the manner indicated by an arrow 60 in FIG. 5.

As the lid 26 moves to its open position, an outer surface 64 (FIG. 3) on the handle 34 moves into engagement with a support surface 66 (FIG. 5). The handle 34 is then effective to support the lid 26 in a generally horizontal orientation extending outward, that is, toward the left as viewed in FIG. 5, from the base 24 of the housing 22. It should be understood that the handle 34 could have a different construction and cooperate with the lid 26 in a different manner if desired.

Figure 6:
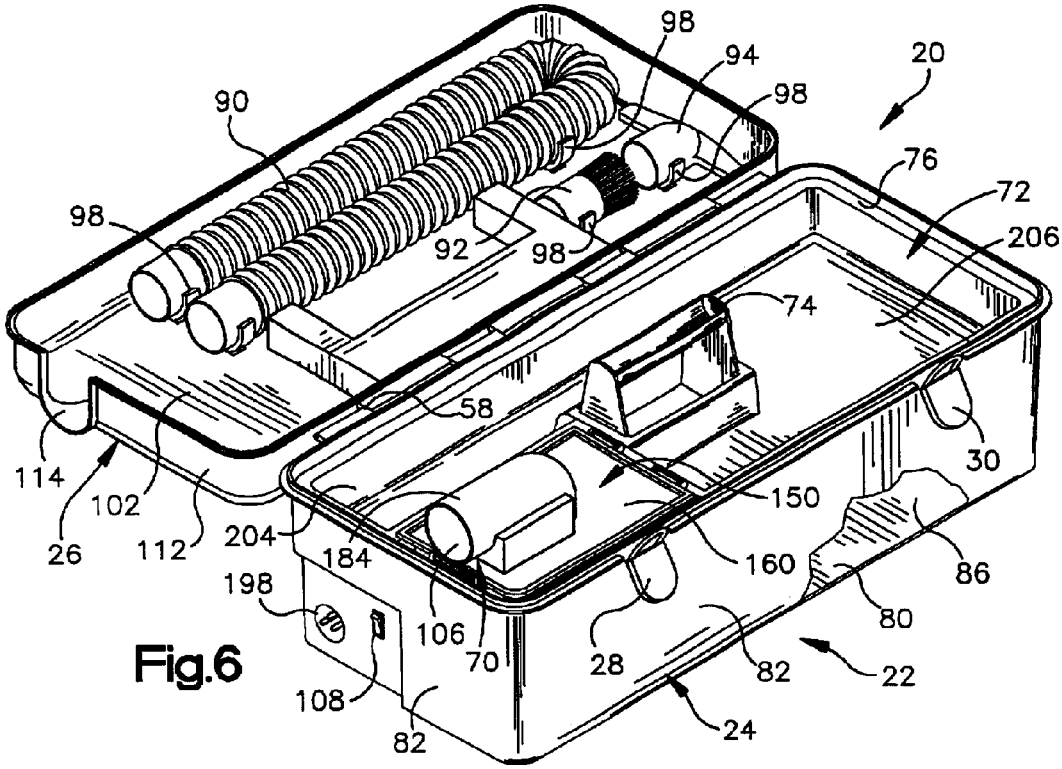
FIG. 6 is a partially broken away schematic illustration, taken generally along the line 6—6 of FIG. 5, illustrating the interior of a base of the housing.

The base 24 of the housing 22 encloses a vacuum cleaner 70 and a tray 72 (FIG. 6). The tray 72 may be utilized to hold hand tools, such as screwdrivers and/or hammers. The tray 72 may also be utilized to hold parts, such as nails, screws, washers, etc.

Although the tray 72 has been illustrated in FIG. 6 as having a single large compartment, it should be understood that a number of compartments could be formed by partitions disposed in the tray. The tray 72 may be divided into a plurality of relatively small compartments to hold and separate fasteners, small parts, and/or other small items.

The illustrated tray 72 is removable from the base 24 of the housing 22. Therefore, the tray 72 is provided with a handle 74 connected with a central portion of the tray. However, if desired, the tray 72 could be fixedly mounted in the base 24 of the housing 22. Alternatively, a portion of the tray 72 could be removable from the housing and another portion of the tray could be fixedly mounted in the housing. The tray 72 has a lip 76 (FIG. 5) which engages a projection 78 molded into the side walls 82 of the base 24 to support the tray above a bottom wall 80 of the base.

Figure 7:
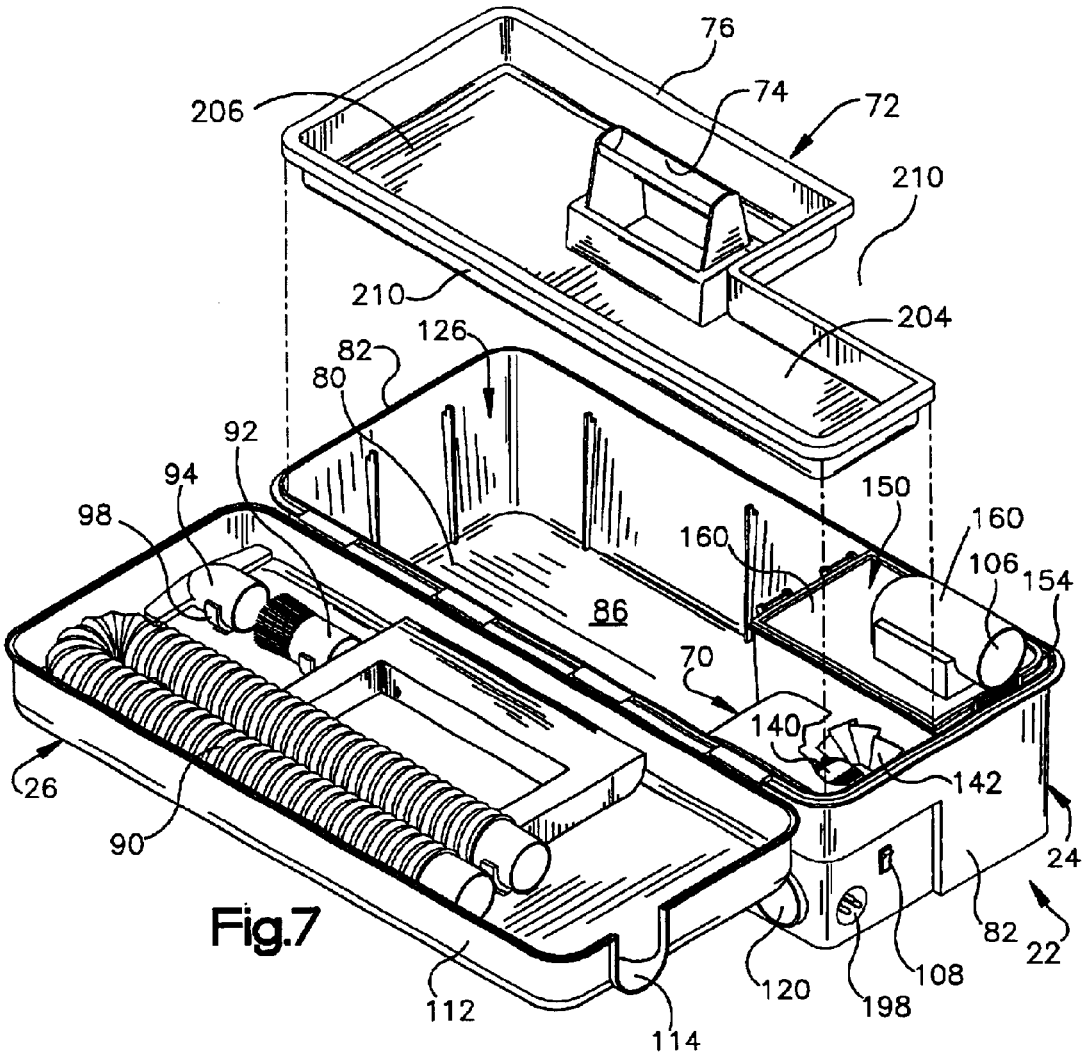
FIG. 7 is a pictorial illustration of the housing with a motor, impeller, and dust bin installed in the base of the housing.

The tray 72 cooperates with the bottom wall 80 and sidewalls 82 of the generally rectangular base 24 to form a storage space or compartment 86 (FIGS. 5 and 6). Access is obtained to the storage space 86 by removing the tray 72 from the base 24 (FIG. 7). If desired, the storage space 86 could be compartmentalized by partitions disposed in the base 24. However, it is believed that it may be desired to leave the storage space uncompartmentalized so that relatively large items, such as a machine component, a hand tool, and/or a measuring tool, such as a volt meter, could be held in the storage space 86.

When the lid 26 is in the open position illustrated in FIG. 6, access is obtained to the interior of the lid. In the embodiment of the invention illustrated in FIG. 6, articles used with the vacuum cleaner 70 are retained within the lid 26. The articles which are retained in the lid 26 are known articles which are commonly used with a vacuum cleaner. These articles may includes a hose 90, a brush 92 which can be connected with the hose, and a crevice tool or nozzle 94 which can be connected with the hose. It should be understood that articles other than the specific articles illustrated in FIG. 6 could be mounted on the inside of the lid 26. For example, the electrical power cord 44 and/or a hand tool could be stored inside the lid 26.

Suitable retainers 98 are connected with an upper wall 102 of the lid 26 to hold the hose 90, brush 92 and nozzle 94 and/or any other desired articles on the lid 26. Although the articles 90, 92 and 94 have been illustrated in FIG. 6 as being disposed on the inside of the lid 26, it is contemplated that the articles could be retained on the outside of the lid. This would provide access to the articles when the lid 26 is In the closed condition of FIG. 1 rather than the open condition of FIG. 6.

When the vacuum cleaner 70 is to be utilized to clean dust and/or debris, the hose 90 is disconnected from the retainers 98 on the lid 26. The hose 90 is then connected with an inlet 106 for the vacuum cleaner 70. The electrical power cord 44 (FIG. 1) is connected with a source of power and with the vacuum cleaner 70 to provide electrical energy for operation of the vacuum cleaner.

During operation of the vacuum cleaner 70, a flow of air with dust and/or debris entrained therein is conducted through the hose 90 to the vacuum cleaner 70. An on-off switch 108 (FIGS. 6 and 7) on the outside of the base 24 is actuated to effect operation of the vacuum cleaner 70. Although it is preferred to mount the switch 108 on the outside of housing 22, the switch could be mounted inside the housing if desired.

The vacuum cleaner 70 can advantageously be operated with the tray 72 in the base 24. Although the lid 26 may be in the open condition of FIG. 6 during operation of the vacuum cleaner 70, a rim portion 112 (FIG. 4) of the lid 26 is provided with an opening 114 which enables the lid to be closed when the hose 90 (FIG. 6) is connected with the vacuum cleaner 70. The hose 90 may be connected with the inlet 106 to the vacuum cleaner 70 and utilized to perform vacuum cleaning functions while the lid 26 is in the closed condition of FIGS. 1 and 4.

Figure 10:
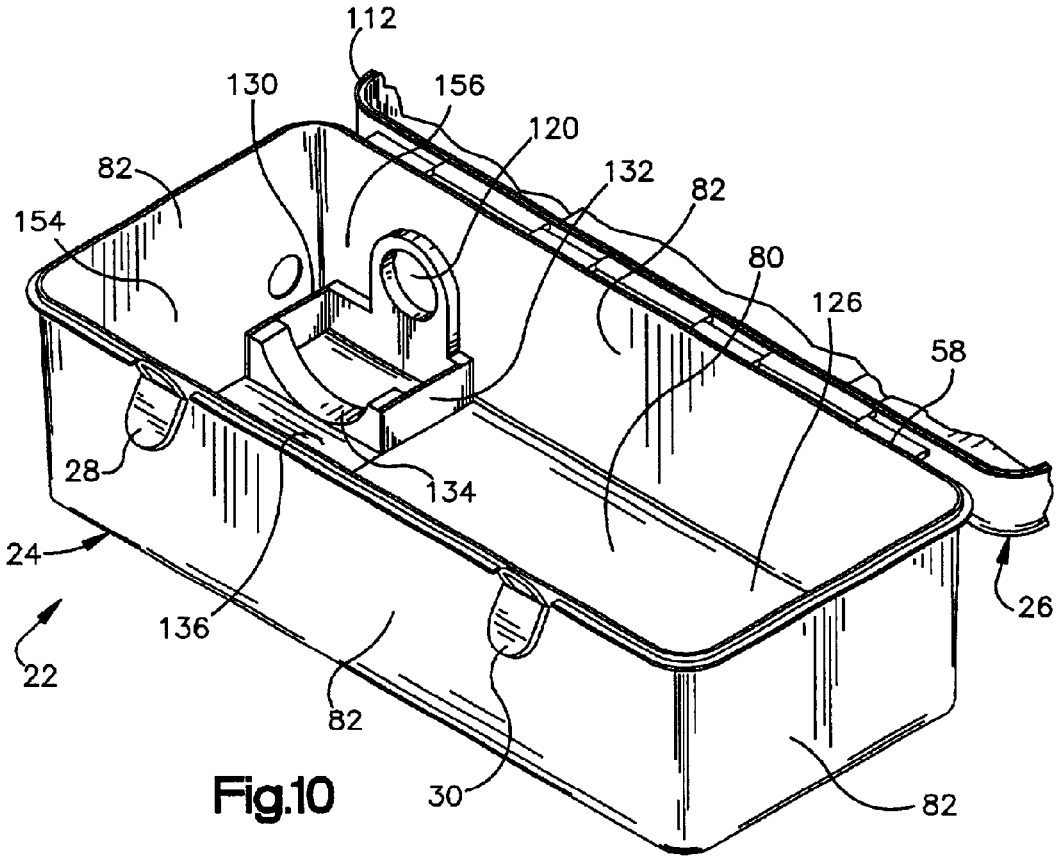
FIG. 10 is a partially broken away schematic illustration of the base of the housing prior to installation of vacuum cleaner components in the base.

It is contemplated that it may be desired to utilized the vacuum cleaner 70 as a blower rather than as a source of suction. When this is to be done, the hose 90 is connected with an outlet 120 (FIGS. 7 and 10) from the vacuum cleaner 70. When the hose 90 is connected with the outlet 120 from the vacuum cleaner 70, a flow of air is conducted from the vacuum cleaner through the hose 90. This flow of air may be utilized to dislodge dust and/or debris which may be inaccessible and relocate the dust and debris to a more accessible location.

Housing

Although the housing 22 (FIGS. 6 and 7) could be formed in many different ways, it is believed that it may be desired to mold the housing of a suitable polymeric material. When this is done, the base 24 of the housing may be molded as one-piece of polymeric material and the lid 26 of the housing molded as a second piece of polymeric material. The lid 26 and base 24 are pivotally connected at the hinge 58.

Of course, the housing 22 could be formed of a different material if desired. For example, the housing could be formed of metal. If the housing 22 is formed of metal, it may be formed of stamped sheet metal or molded metal. It is contemplated that the housing 22 could be formed of a combination of metal and polymeric materials if desired.

The base 24 of the housing 22 (FIG. 7) has a generally rectangular configuration. The sidewalls 82 of the base of the housing cooperate with the bottom wall 80 to define a generally rectangular chamber 126. It should be understood that the housing 22 and chamber 126 could have a configuration other than the illustrated rectangular configuration. For example, the housing 22 and/or chamber 126 could have a cylindrical configuration.

The vacuum cleaner 70 (FIG. 7) is disposed at one end portion, that is the right end portion, as viewed in FIG. 7, of the chamber 126. Of course, the vacuum cleaner 70 could be disposed in a different portion of the chamber 126. For example, the vacuum cleaner 70 could be disposed in a central portion of the chamber 126.

Components of the vacuum cleaner 70 may be integrally molded as one-piece with the bottom wall 80 of the base 24.

Thus, the bottom wall 80 includes a lower motor support structure 130 (FIG. 10) which is integrally molded as one-piece with the bottom wall 80 and sidewalls 82 of the base 24. The lower motor support structure 130 includes a lower portion 132 of a motor housing and a lower portion 134 of an impeller housing. In addition, a lower portion 136 of a dust bin is integrally molded with the base 24. If desired, all of the components of the vacuum cleaner 70 could be formed separately from the base 24.

Figure 9:
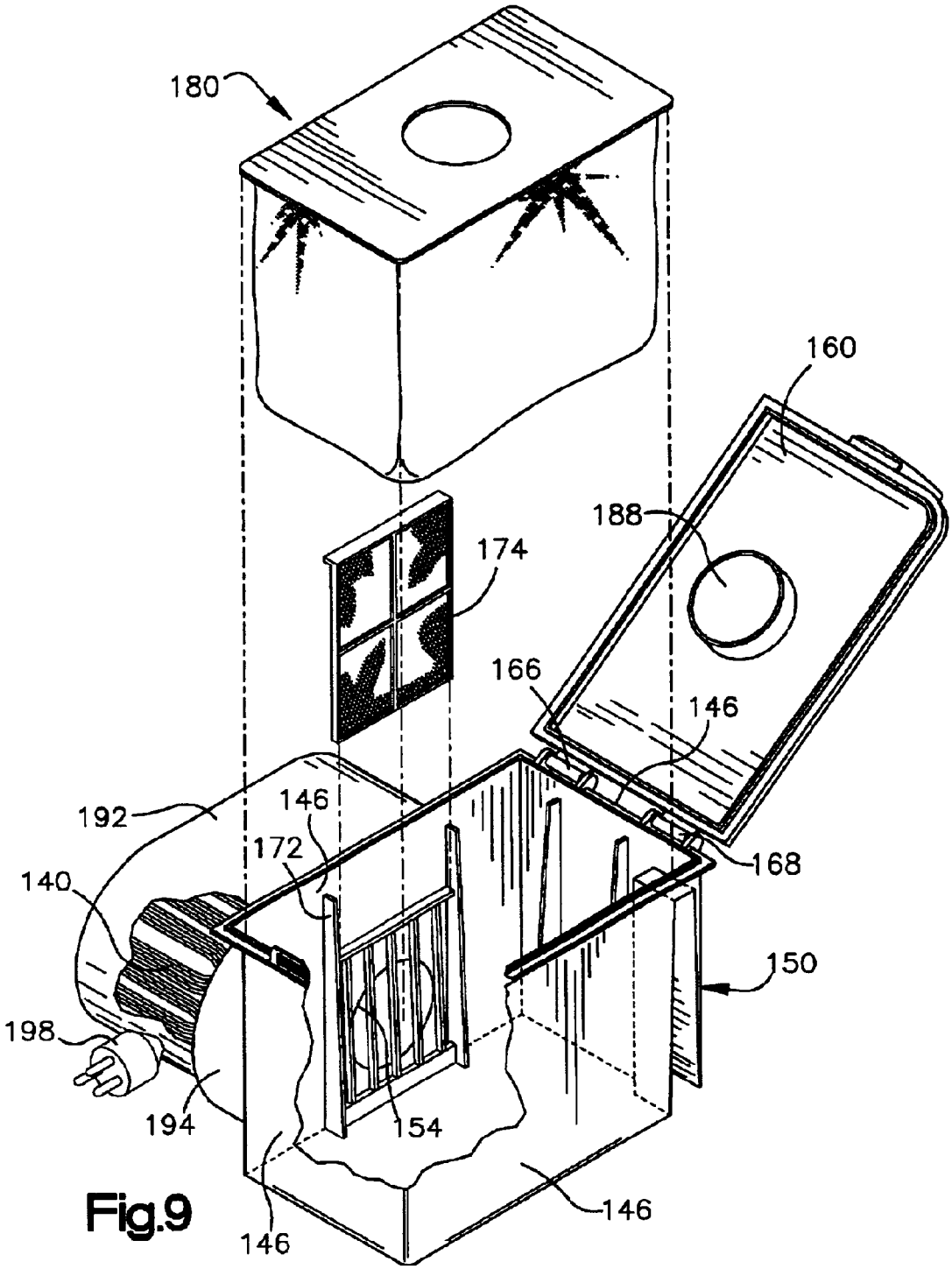
FIG. 9 is a partially broken away schematic illustration depicting the manner in which the cover of the dust bin is movable to an open condition and in which a pre-filter for a motor of the vacuum cleaner and a dust bag or other filter are installed in the dust bin.

An electric motor 140 (FIGS. 7 and 9) is mounted on the lower portion 132 (FIG. 10) of the motor housing. A circular impeller 142 (FIG. 7) is mounted in the lower portion 134 (FIG. 10) of the impeller housing in a coaxial relationship with the motor 140. Sidewalls 146 (FIG. 9) of a dust bin 150 are fixedly connected with the lower portion 136 (FIG. 10) of the dust bin. A circular opening 154 (FIG. 9) in a wall 146 of the dust bin 150 connects the dust bin 150 in fluid communication with the impeller 142 (FIG. 7).

The dust bin 150 is disposed in a corner portion 154 (FIG. 10) of the chamber 126 and base 24. Similarly, the motor 140 and impeller 142 (FIG. 7) are disposed in a corner portion 156 (FIG. 10) of the chamber 126 and base 24. However, if desired, the dust bin 150, motor 140 and impeller 142 could be mounted in a central portion of the chamber 126 in the base 24.

Figure 8:
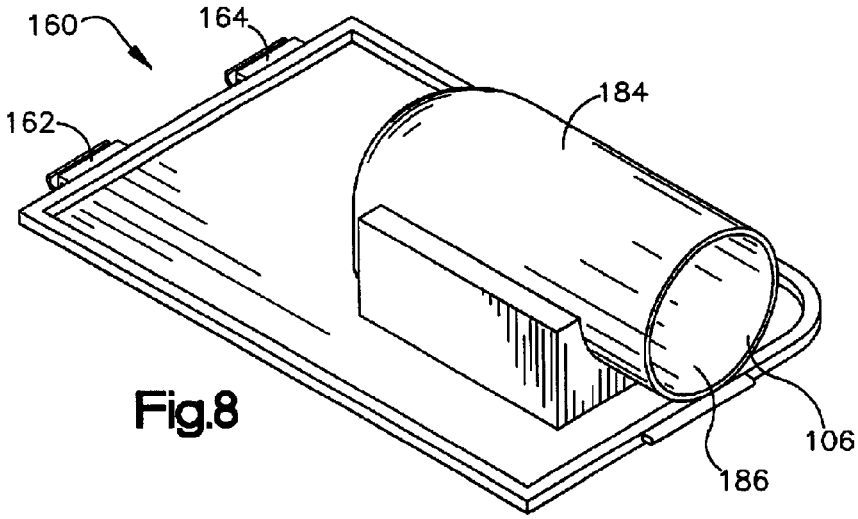
FIG. 8 is an enlarged illustration of a cover for the dust bin of FIG. 7.

A dust bin cover 160 (FIG. 8) has a pair of hinge arms 162 and 164 which are used to connect the cover 160 with hinge pins 166 and 168 (FIG. 9) on the dust bin 150. The cover 160 is pivotal relative to the hinge pins 166 and 168 between the closed condition illustrated in FIGS. 6 and 7 and the open condition illustrated in FIG. 9. Although the dust bin 150 and dust bin cover 160 are molded of polymeric material, they could be formed in a different manner.

When the dust bin cover 160 is in the closed position of FIGS. 6 and 7, the dust bin cover is offset to one side of the tray 72. However, when the dust bin cover 160 is pivoted to the open position (FIG. 9), the dust bin cover overlies a portion of the tray 72. Of course, the dust bin cover 160 could be moved between open and closed positions in a different manner if desired. For example, the dust bin cover 160 could be pulled straight upward from the closed position of FIGS. 6 and 7 and moved to an open position spaced from the base 24.

A motor pre-filter holder 172 (FIG. 9) may be disposed in the dust bin 150 in alignment with the opening 154 to the impeller 142 and motor 140. A filter 174 is movable into the motor pre-filter holder 172 while the dust bin cover 160 is in the open position. In addition, a dust bag or other filter 180 is positioned in the dust bin 150 when the dust bin cover 160 is in the open condition illustrated in FIG. 9. Rather than the using the dust bag 180 as a filter for a flow of air into the dust bin 150, a dirt cup could be positioned in the dust bin 150. It is contemplated than any known type of filter or filters could be utilized in the dust bin 150.

An inlet fitting 184 (FIG. 8) is disposed on the dust bin cover 160. The inlet fitting 184 has a tubular construction with a passage 186. The passage 186 extends from the inlet 106 to the interior of the dust bin 150 through an opening 188 (FIG. 9) formed in the cover 160. An end portion of the hose 90 is telescopically inserted into the inlet fitting 184 to connect the hose 90 in fluid communication with filters in the dust bin 150 through the passage 186. It should be understood that the dust bin cover 160 could have any desired construction.

An upper portion 192 (FIG. 9) of the motor housing may be integrally molded as one piece with the dust bin sidewalls 156. An upper portion 194 of an impeller housing cooperates with the lower portion 134 (FIG. 10) of the impeller housing to enclose the impeller 142 (FIG. 7).

A plug-type electrical connector 198 (FIG. 9) is accessible through an opening in the base 24 (FIGS. 1, 4 and 7). The electrical connector 198 is fixedly connected with the base 24.

Tray

The tray 72 (FIG. 6) is effective to divide a portion of the chamber 126 (FIG. 8), which is not occupied by the vacuum cleaner 70, into upper and lower storage locations. The storage space 86 (FIG. 6) is disposed below the tray 72. The tray 72 may be compartmentalized to separate stored items. It is contemplated that relatively small items will be stored in the tray 72 and that larger items will be stored in the storage space 86.

When the tray 72 is positioned in the base 22, in the manner illustrated in FIGS. 6, an arm portion 204 (FIG. 7) of the tray 72 overlies the upper portion 192 (FIG. 9) of the motor housing and is disposed adjacent to the dust bin 150. The arm portion 204 (FIG. 7) and a generally rectangular main portion 206 of the tray 72 cooperate to form a generally rectangular recess 210 which receives the dust bin 150.

Although the arm portion 204 (FIG. 7) of the tray 72 overlies the upper portion 192 (FIG. 9) of the motor housing, the tray 72 does not overlie the dust bin 150. This enables the dust bin cover 160 to be pivoted between the closed condition of FIGS. 6 and 7 and the open condition of FIG. 9 when the tray 72 is disposed in the base 24. This enables the filters 174 and 180 in the dust bin 150 to be changed while the tray 72 is disposed in the base 24.

Second Embodiment

Figure 11:
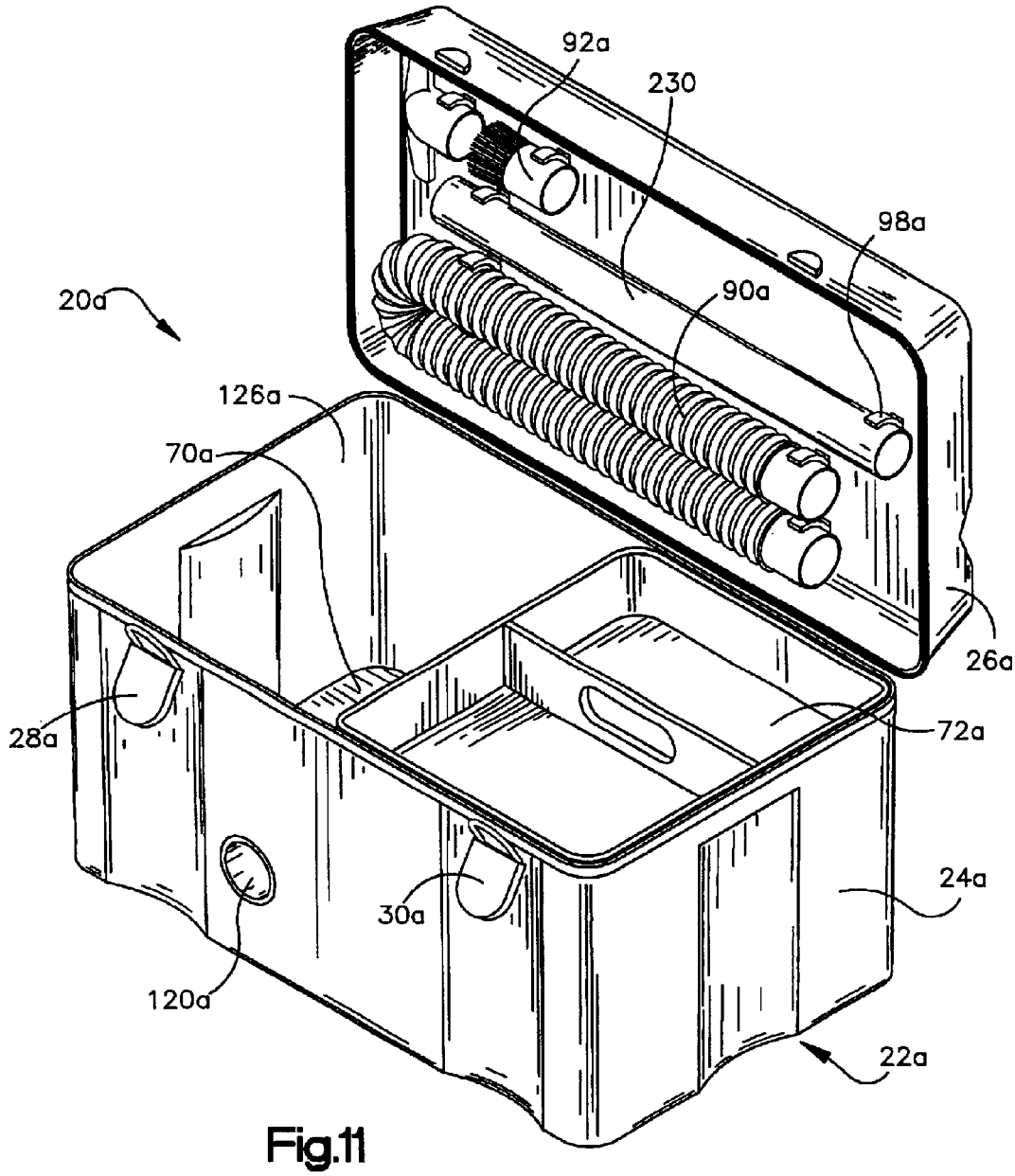
FIG. 11 is a schematic illustration of a second embodiment of the cleaning and tool storage assembly.
Figure 12:
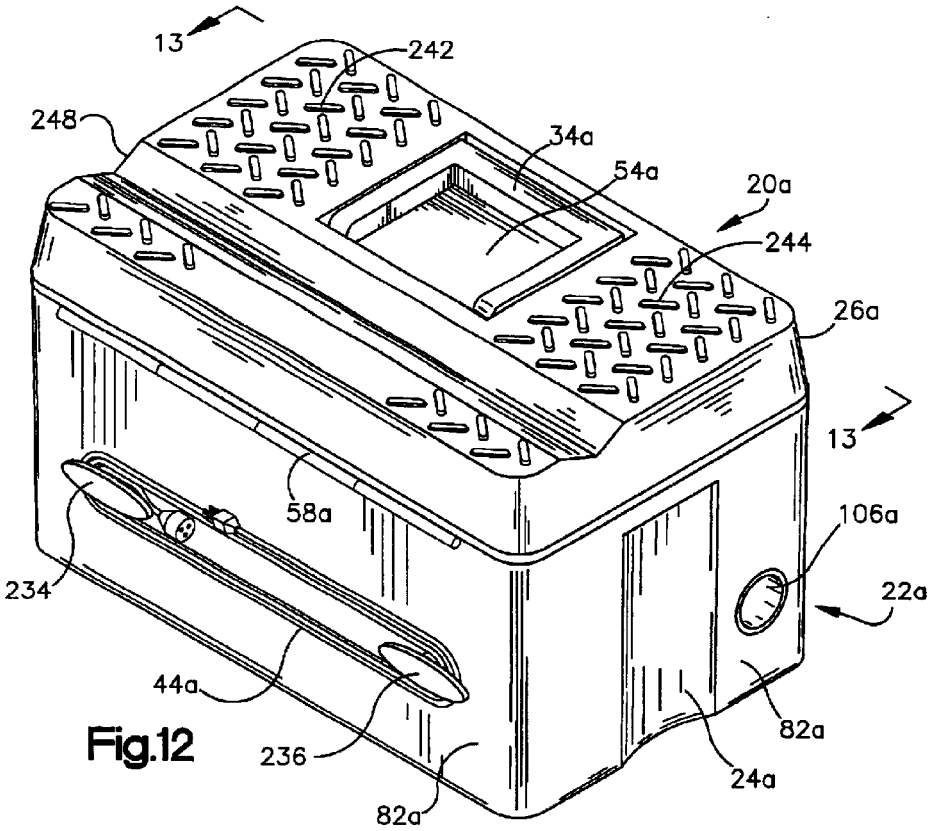
FIG. 12 is a pictorial illustration of the cleaning and tool storage assembly of FIG. 11.
Figure 13:
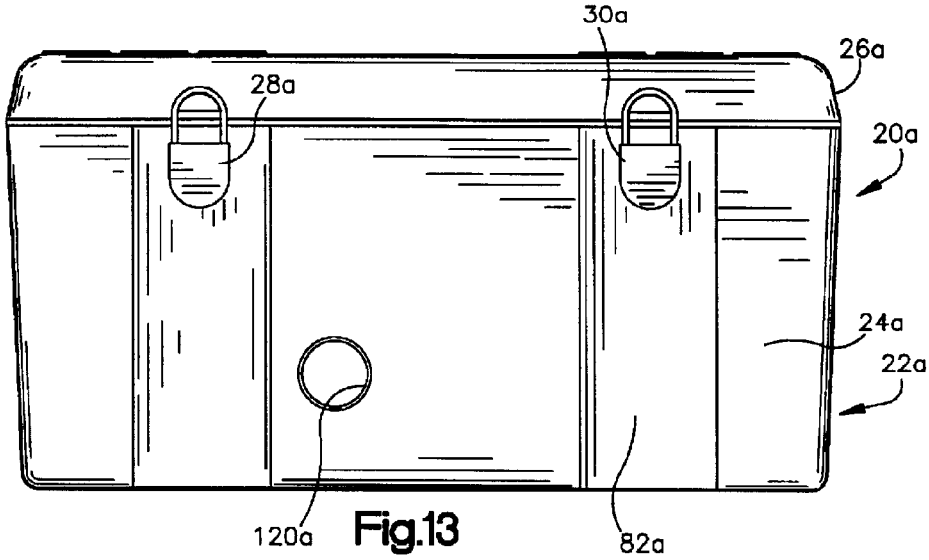
FIG. 13 is an elevational view, taken generally along the line FIG. 13—13 of FIG. 12.

A second embodiment of the cleaning and tool storage assembly 20 is illustrated in FIGS. 11–13. Since the embodiment of the invention illustrated in FIGS. 11–13 is generally similar to the embodiment of the invention illustrated in FIGS. 1–10, similar components will be designated by similar numerals, the suffix letter "a" being added to the numerals of FIGS. 11–13 to avoid confusion.

A cleaning and tool storage assembly **20*a* (FIG. 11) includes a housing 22*a* having a generally rectangular base 24*a* and a lid 26*a*. The lid 26*a* is illustrated in an open condition in FIG. 11 and in a closed condition in FIGS. 12 and 13. Releasable latches 28*a* and 30*a* are provided to retain the lid 26*a* in the closed condition illustrated in FIG. 13**.

When the lid **26*a* is in the open condition illustrated in FIG. 11, access is provided to a tray 72*a* in the base 24*a* of the housing 22*a*. Although the tray 72*a* may be fixedly mounted within the base 24*a*, the tray is removable from the base. When the tray 72*a* is removed from the base 24*a***, access is provided to a storage space disposed beneath the tray.

In addition to the tray and storage space, a vacuum cleaner **70*a* is disposed in a chamber 126*a* in the base 24*a*. The vacuum cleaner 70*a* includes a dust bin, electric motor and impeller in a manner previously explained in conjunction with the embodiment of the invention illustrated in FIGS. 1–10. An inlet 106*a* (FIG. 12) to the vacuum cleaner 70*a* is disposed in a sidewall 82*a* of the base 24*a*. An outlet 120*a* (FIG. 13) is provided in a sidewall 82*a* of the base 24*a***.

In the embodiment illustrated in FIG. 12, treads 242 and 244 are provided on the lid **26*a* to facilitate standing on the cleaning and tool storage assembly 20. The handle 34*a* is disposed between the treads 242 and 244. The treads 242 and 244 have a pattern of ridges and/or grooves which provide a slip retarding surface on the lid 26***a*. Of course, a person standing on the cleaning and tool storage assembly 20*a* should use care when stepping onto, standing on, and stepping off of the treads 242 and 244.

A linear, generally V-shaped groove 248 (FIG. 12) is provided in the lid 26*a*. The groove 248 may be utilized to hold a cylindrical member, such as a pipe, during cutting of the member. Although the treads 242 and 244 and groove 248 are not included in the lid 26 of the embodiment of the invention illustrated in FIGS. 1–10, it is contemplated that the treads and grooves could be provided in the lid 26 of the embodiment illustrated in FIGS. 1–10, if desired. Alternatively, the treads 242 and 244 and groove 248 could be omitted from the embodiment of FIGS. 11–13.

Having described the invention, the following is claimed:

1. An assembly comprising:

a vacuum cleaner;

a housing defining a chamber containing said vacuum cleaner, said housing including a base and a lid hingedly connected to said base for movement between open and closed conditions, said lid having a manually engageable handle to facilitate carrying of said assembly when said lid is in the closed condition; and a tray to hold items in said base, said items being removable from said tray when said lid is in the open condition;

said handle is movable relative to said lid between a stored condition and a carrying condition, said handle being disposed in a recess in said lid when said handle is in the stored condition, said handle being at least partially disposed outside of said recess in said lid when said handle is in the carrying condition, said handle includes projections to hold an electrical power cord on said handle when said handle is in the carrying condition.

2. The assembly as set forth in claim 1 further including an on-off switch disposed on said base of said housing and connected with said vacuum cleaner, said on-off switch being operable between an on condition in which said vacuum cleaner is energized by electrical energy conducted to said on-off switch through the electrical power cord and an off condition in which said vacuum cleaner is deenergized.

3. The assembly as set forth in claim 1 further including an inlet connected with said base of said housing to receive an end portion of a hose through which air is drawn into said vacuum cleaner when said vacuum cleaner is energized and an outlet connected with said base of said housing through which air flows when said vacuum cleaner is energized.

4. The assembly as set forth in claim 3 further including an on-off switch mounted on said base and actuatable from outside of said housing to effect energization and de-energization of said vacuum cleaner.

5. An assembly comprising:

a vacuum cleaner;

a housing defining a chamber containing said vacuum cleaner, said housing including a base and a lid hingedly connected to said base for movement between open and closed conditions, said lid having a manually engageable handle to facilitate carrying of said assembly when said lid is in the closed condition; and a tray to hold items in said base, said items being removable from said tray when said lid is in the open condition;

said vacuum cleaner includes a motor, an impeller, and a dust bin which are disposed in said base, said dust bin having an inlet through which air with material entrained therein is drawn and an outlet through which a flow of air is conducted from said dust bin during operation of said motor, and a filter disposed in said dust bin to remove material entrained in the flow of air through said inlet.

6. An assembly comprising:

a vacuum cleaner;

a housing defining a chamber containing said vacuum cleaner, said housing including a base and a lid hingedly connected to said base for movement between open and closed conditions, said lid having a manually engageable handle to facilitate carrying of said assembly when said lid is in the closed condition;

said handle includes a retainer which is movable between an extended position in which said retainer is effective to retain an electrical power cord on said handle and a retracted position; and a tray to hold items in said base, said items being removable from said tray when said lid is in the open condition.

7. An assembly comprising:

a vacuum cleaner;

a housing defining a chamber containing said vacuum cleaner, said housing including a base and a lid hingedly connected to said base for movement between open and closed conditions, said lid having a manually engageable handle to facilitate carrying of said assembly when said lid is in the closed condition; and a tray to hold items in said base, said items being removable from said tray when said lid is in the open condition;

said handle includes a pair of mounting sections which are connected with said lid, a manually engageable grip section which extends between said mounting sections, a first retainer member which is movable between a retracted position in which said first retainer member is at least partially enclosed by said grip section and an extended position in which said first retainer member extends outward from said grip section in a first direction, and a second retainer member which is movable between a retracted position in which said second retainer member is at least partially enclosed by said grip section and an extended position in which said second retainer member extends outward from said grip section in a second direction opposite from said first direction, said first and second retainer members being effective to retain an electrical power cord on said handle when said first and second retainer members are in their extended positions.

8. An assembly comprising:

a vacuum cleaner, said vacuum cleaner includes a dust bin having a cover which is movable from a closed condition to an open condition to provide access to an interior of said dust bin;

a housing defining a chamber containing said vacuum cleaner, said housing including a base and a lid hingedly connected to said base for movement between open and closed conditions, said lid having a manually engageable handle to facilitate carrying of said assembly when said lid is in the closed condition; and a tray to hold items in said base, said items being removable from said tray when said lid is in the open condition, said tray having a recess which provides access to said cover and enables said cover to be moved between the open and closed conditions when said tray is disposed in said base.

9. An assembly comprising:

a vacuum cleaner, said vacuum cleaner includes a dust bin having a cover which is movable from a closed condition to an open condition to provide access to an interior of said dust bin, and a suction inlet connected with said dust bin cover and adapted to be connected with a hose through which a flow of air with material entrained is conducted;

a housing defining a chamber containing said vacuum cleaner, said housing including a base and a lid hingedly connected to said base for movement between open and closed conditions, said lid having a manually engageable handle to facilitate carrying of said assembly when said lid is in the closed condition; and a tray to hold items in said base, said items being removable from said tray when said lid is in the open condition.

10. An assembly comprising:

a vacuum cleaner;

a housing defining a chamber containing said vacuum cleaner, said housing including a base and a lid hingedly connected to said base for movement between open and closed conditions, said lid having a manually engageable handle to facilitate carrying of said assembly when said lid is in the closed condition; and a tray to hold items in said base, said items being removable from said tray when said lid is in the open condition;

said base has a generally rectangular configuration, said vacuum cleaner includes a dust bin disposed in a first corner portion of said base and a motor disposed in a second corner portion of said base, said dust bin and motor being spaced from third and fourth corner portions of said base, said tray being disposed above a bottom wall of said base and being at least partially disposed in said third and fourth corner portions of said base.

11. The assembly as set forth in claim 10 wherein said dust bin has a cover which is movable from a closed condition to a open condition to provide access to an interior of said dust bin, said tray having a recess which provides access to said cover and enables said cover to be moved between the open and closed conditions when said tray is disposed in said base.

12. The assembly as set forth in claim 10 wherein said vacuum cleaner includes a dust bin having a cover which is movable from a closed condition to an open condition to provide access to an interior of said dust bin, and a suction inlet connected with said dust bin cover and adapted to be connected with a hose through which a flow of air with material entrained is conducted.

13. The assembly as set forth in claim 10 wherein at least a portion of said tray is disposed above said motor.

14. An assembly comprising:

a housing including a base and a lid movable between open and closed conditions;

a dust bin disposed in said base, said dust bin having a cover which is movable from a closed condition to an open condition to provide access to an interior of said dust bin when said lid is in the open condition;

a motor disposed in said base;

an impeller connected in fluid communication with said dust bin and rotatable by said motor to induce a flow of air into said dust bin through an inlet to said dust bin and to induce a flow of air from said dust bin through an outlet from said dust bin, said inlet to said dust bin being connected with said cover and being movable with said cover between the open and closed conditions of said cover;

a hose which is connectable with said inlet to said dust bin to enable a flow of air with material entrained therein to be conducted from said hose through said inlet to said dust bin during rotation of said impeller, said hose being connectable with said outlet from said dust bin to enable a flow of air to be conducted from said dust bin to said hose, said hose being connectable with said inlet to said dust bin when said lid is in the closed condition; and a storage area located within said base, said storage area having at least one compartment to accommodate storage of hand held articles.

15. The assembly as set forth in claim 14 wherein said storage area includes a tray to hold items in said base, said tray having a recess in which said cover to said dust bin is disposed when said cover is in the closed condition.

16. The assembly as set forth in claim 14 wherein said storage area includes a tray to hold items in said base, said tray having an edge portion which is disposed adjacent to said upper portion of said base, said inlet to said dust bin is at least partially disposed at a level above said edge portion of said tray.

17. The assembly as set forth in claim 16 wherein said cover to said dust bin is offset from said tray when said cover is in the closed condition and overlies a portion of said tray when said cover is in the open condition.

18. The assembly as set forth in claim 16 wherein said tray is removable from said base to provide access to said storage space.

19. The assembly as set forth in claim 14 wherein said lid has an upper wall and a rim which extends downward from said upper wall of said lid, said inlet to said dust bin being at least partially aligned with an opening is said rim of said lid when said lid is in the closed condition.

20. The assembly as set forth in claim 14 further including means disposed on said lid for holding articles to be connected with said hose.

* * * * *